United States Patent [19]

Wimberger et al.

[11] Patent Number: 4,942,676

[45] Date of Patent: Jul. 24, 1990

[54] CONTROL SYSTEM FOR AIR FLOTATION DRYER WITH A BUILT-IN AFTERBURNER

[75] Inventors: Richard J. Wimberger, DePere; Donald L. Wickesberg, Neenah; Richard A. Carman, Green Bay, all of Wis.

[73] Assignee: W. R. Grace & Co.-Conn., Lexington, Mass.

[21] Appl. No.: 203,129

[22] Filed: Jun. 7, 1988

[51] Int. Cl.[5] ..... F26B 21/06

[52] U.S. Cl. ..... 34/51; 34/16; 34/26; 34/54; 34/155

[58] Field of Search ..... 34/16, 26, 27, 30, 32, 34/36, 47, 51, 54, 72, 155, 212, 219

[56] References Cited

U.S. PATENT DOCUMENTS

| | | | |
|---|---|---|---|
| 2,706,344 | 4/1955 | Vaughan | 34/17 X |
| 2,743,529 | 5/1956 | Hayes | 34/35 |
| 2,750,680 | 6/1956 | Houdry et al. | 34/35 |
| 2,795,054 | 6/1957 | Bowen | 34/35 |
| 3,561,928 | 2/1971 | Weber | 23/388 |
| 3,757,427 | 9/1973 | Wilkinson | 34/32 |
| 3,800,429 | 4/1974 | Lindl | 34/79 |
| 3,874,091 | 4/1975 | Fukumoto | 34/66 |
| 3,875,678 | 4/1975 | Vits | 34/32 |
| 3,882,612 | 5/1975 | Try et al. | 34/27 |
| 3,909,953 | 10/1975 | Hemsath et al. | 34/26 |
| 3,936,951 | 2/1976 | Haueise et al. | 34/219 X |
| 4,116,620 | 9/1978 | Stibbe | 34/155 X |
| 4,205,553 | 6/1980 | Ellison et al. | 34/28 |

FOREIGN PATENT DOCUMENTS 2829092 7/1978 Fed. Rep. of Germany .

*Primary Examiner*—Harry B. Tanner
*Attorney, Agent, or Firm*—Hugh D. Jaeger

[57] ABSTRACT

A control system for a compact efficient air flotation dryer with a built-in afterburner for combustion of solvent-laden air within a dryer-enclosed combustion chamber. An internal exhaust fan propels internal solvent-laden air across a burner where it combusts, causing a heat rise. Heated, combusted air is routed to a recirculating supply air fan which provides pressurized heated air for air bars for drying a web. Heated air in excess of that required to dry the web is vented externally and helps to maintain desired solvent concentration levels. Variable parameters such as fan speed, burner temperatures, air box pressures, exhaust air rate, solvent concentration, supply air flow, supply air temperature and damper position are monitored, and the components are actuated to effect a high level of clean up efficiency. The control system provides for the coordinated control of the exhaust fan speed, damper positions, and burner firing. The control system utilizes a computer in real time processing to monitor and control the electrical and electromechanical components.

23 Claims, 15 Drawing Sheets

LEGEND

CONTROL SYSTEM FOR AIR FLOTATION DRYER WITH A BUILT-IN AFTERBURNER

This patent application relates to an "Air Flotation Dryer with a Built-in Afterburner", Ser. No. 07/203,137, filed June 7, 1988, by Wimberger et al., and assigned to the same assignee as this patent.

BACKGROUND OF THE INVENTION

1. Field of the Invention

The present invention relates to a control system for a web dryer such as for use in drying of a web in the printing industry, and more particularly, pertains to a control system for an air flotation dryer with a built-in afterburner which uses internal solvent-laden air as a combustion medium to generate high internal drying temperatures for use in drying a web.

2. Description of the Prior Art

Prior art flotation dryers have been large and bulky in physical size, and have not operated at high efficiencies. Heat exchangers have been required in prior art systems to recapture heat in spent air. Burners would require excessive fuel in burning of the solvent laden air.

Prior art web dryers were notorious in being operationally inefficient in web drying, consuming large amounts of physical floor space, and lacking in sophisticated computerized monitoring and control of the web dryer. Prior art web dryers attempted to reduce to a negligible amount the solvent concentration exhausted into the atmosphere through a variety of methods such as by using incinerators to combust the solvents in the dryer air, then attempting to recover the heat from the burned or combusted solvents by heat exchangers. Other methods include removing solvents from the air with the use of catalytic converters.

Two representative prior art patents are "Method and Apparatus for Purifying Exhaust Air of a Dryer Apparatus", U.S. Pat. No. 3,875,678 and "Method of Curing Strip Coating", U.S. Pat. No. 4,206,553. Both of these patents disclose prior art dryers as discussed above.

The present invention overcomes the disadvantages of the prior art by providing a control system which is applicable for use in an air flotation dryer with afterburners for drying of a web and which provides for control of electrical and electromechanical components on a real time basis.

SUMMARY OF THE INVENTION

The general purpose of the present invention is to provide a control system for a compact and efficient air flotation dryer with a built-in afterburner where solvent-laden evaporate is combusted. This subsequently creates a heat source for use in drying a web, and also combusting a great majority of harmful noxious or pollutant vapors before such air is released into the atmosphere. Solvent-laden evaporate is propelled by an exhaust fan across a burner, which uses various premixes of a fuel medium and air, for combustion by the burner. The heat from the combusted solvents flow by forced air through an optional monolith catalyst, into a heat distribution chamber to be ducted to the interior of the enclosure, and to be propelled by a recirculation supply fan through additional ducting, and subsequently to air bars. The heated air may also alternatively be routed to the air bars through a sparger and a static mixer in series with the recirculating supply fan. Excess combusted air may be routed externally through an exhaust duct.

According to one embodiment of the present invention, there is provided a control system for an insulated enclosure with four sides, a top and a bottom with access doors disposed along one side, and a system of interconnected fans, ducts, air bars, a burner, cladding and other elements contained therein. A variable speed exhaust fan is ported in the interior of the enclosure and connects to a combustion compartment by a steel duct. The combustion compartment includes a gas supply duct, a burner with air flow mixing plates and profile plates disposed horizontally about the burner and combustion chamber. The upper end of the combustion chamber connects to a transition chamber, which may include an optional monolith catalyst and a heat distribution chamber. The heat distribution chamber includes an exhaust duct with a plurality of ceramic alloy damper vanes therein, perpendicular to a side wall for accommodation of an external chimney flue. The heat distribution chamber also includes a hot air return duct attached thereto, including a plurality of ceramic alloy damper vanes venting to the dryer enclosure. In the alternative, a sparger and static mixer tube can connect the hot air return duct to a recirculating air supply fan. The circulating return air fan is connected by a circulating air plenum directly to a lower supply duct and through a vertical duct to an upper supply duct. The upper and lower supply ducts connect to horizontally oriented, vertically moveable supply headers which connect to a plurality of opposing air bar members. The air bar members secure between opposing upper and lower frame pairs. The control system provides for coordinated control of exhaust fan speed, damper positions and burner firing rate in real time processing by a microprocessor or programmable logic controller. A subroutine controls the functioning of the electrical and electromechanical components.

One significant aspect and feature of the present invention is computer control of exhaust fan speed, damper positioning, and burner firing rate. The exhaust fan speed is controlled with respect to the plenum pressure. The burner firing rate is controlled with respect to the combustion chamber temperature. The supply air temperature is controlled by the position of the hot air return damper which regulates the hot combustion in the burner area.

Another significant aspect and feature of the present invention is a number of computer subroutines which provides for real time processing of data from the monitors for the LFL, the plenum pressure, and the combustion chamber pressure, as well as the monitoring and controlling of other system operational parameters.

Another significant aspect and feature of the present invention is control of both air/web temperature demand and oxidation temperature demand with only one heat source.

Another significant aspect and feature of the present invention is operation at relationships of $O_2$ and methane previously not attainable; therefore, obtaining improved fuel efficiency.

Another significant aspect and feature of the present invention is closed loop control of control of a combination system (dryer/afterburner).

Having thus described the embodiments of the present invention, it is the principal object hereof to provide a control system for an air flotation dryer with an integral built-in afterburner for the combustion of vaporous flammable solvents in laden air within the air flotation dryer.

An object of the present invention is to provide real time control of the exhaust fan speed, burner firing rate, and the damper positions by a computer.

Another object of the present invention is to provide a control system which is applicable for use with any air flotation dryer with a built-in afterburner.

Other objects of the present invention include improved system efficiency by attaining an appropriate relationship of $O_2$ and methane. Control is provided of both air/web temperature demand and oxidation temperature with only one heat source. Closed loop control is also provided for a combination system of an air flotation dryer and an afterburner. While the air flotation dryer and afterburner are disclosed as being in the same housing, any of the components can be located external to the housing structure.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
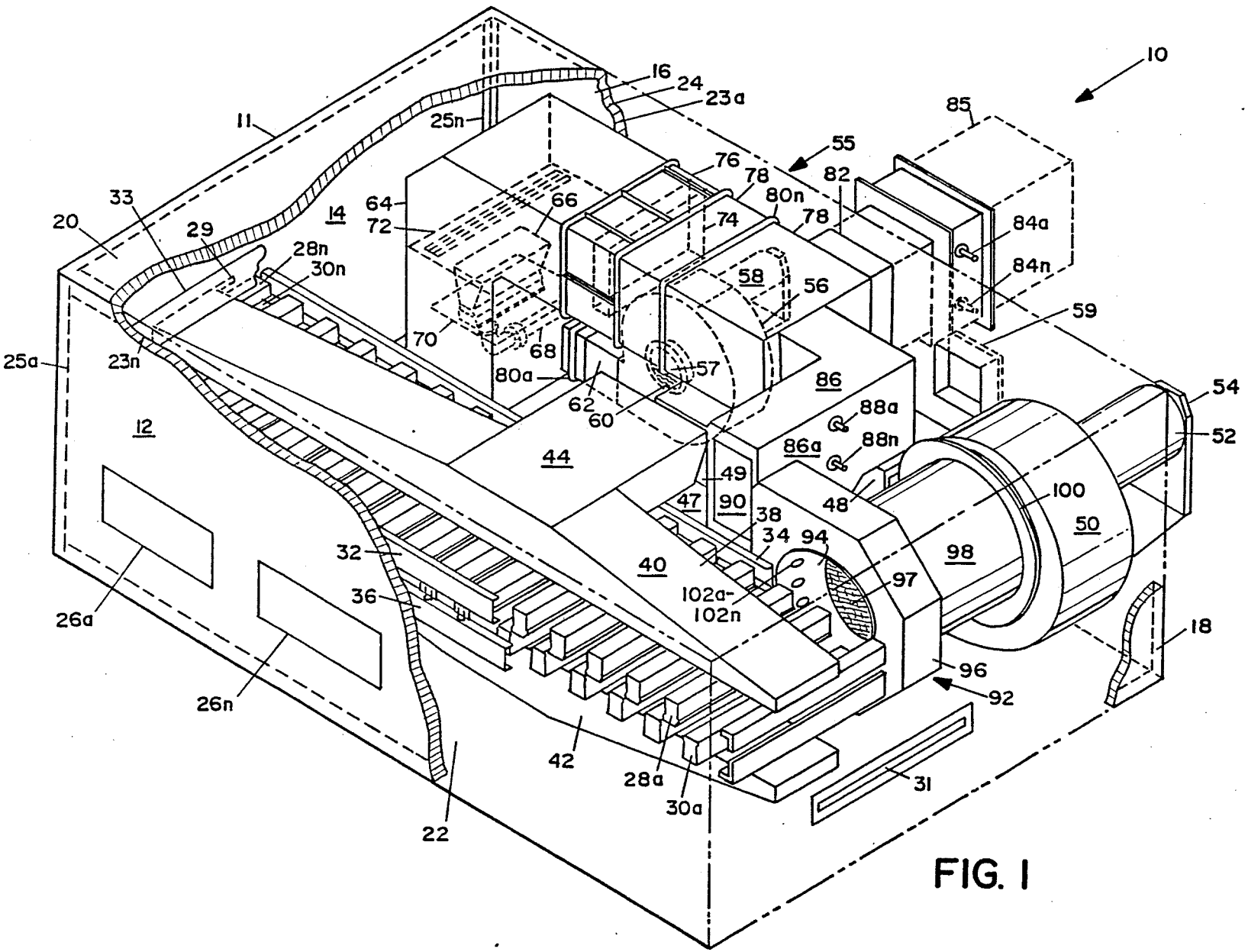
FIG. 1 illustrates a perspective view in cutaway cross section of an air flotation dryer with a built-in afterburner.

FIG. 1 illustrates a perspective view in cutaway cross section of an air flotation dryer with a built-in afterburner, hereinafter referred to and designated the dryer 10. A dryer enclosure 11 includes side members 12, 14, 16, and 18, a top 20 and a bottom 22, each of which includes insulation cladding 24 between a plurality of steel cladding sheets 23*a*–23*n* and the inner surface of each of the members. The side members 12–18, the top 20 and the bottom 22 secure over and about a plurality of frame members 25*a*–25*n*. A plurality of access doors 26*a*–26*n* are disposed along side member 12 for access to a plurality of opposing aligned upper air bars 28*a*–28*n* and lower air bars 30*a*–30*n* mounted in upper frame pairs 32–34 and lower frame pairs 36–38, respectively. A web passes between the pluralities of upper and lower air bars 28*a*–28*n* and 30*a*–30*n*, respectively, for drying of the passing web, and enters and exits the dryer enclosure 11 at slots 29 and 31 on the enclosure sides. A quieting chamber 33 secures over the entry slot 29. An upper air supply header 40 and a lower air supply header 42 provides heated drying air to the respective upper and lower air bars 28*a*–28*n* and 30*a*–30*n*. The upper and lower air supply headers 40 and 42 are hydraulically positioned with respect to the upper and lower air bars 28*a*–28*n* and 30*a*–30*n* in enclosures 132 and 134 illustrated in FIG. 4.

A lower supply duct 46, illustrated in FIGS. 2 and 3, aligns below an upper supply duct 44, and provide pressurized heated drying air to the upper and lower air supply headers 40 and 42. A circulating air plenum 48 of FIG. 3 connects with a vertical duct 49 and a horizontal duct 47, between the upper supply duct 44 and the lower supply duct 46 and delivers recirculated air from a recirculating air supply fan 50 powered by a motor 52 and a drive mechanism 54. Electrically driven dampers 45 and 43 are located in ducts 49 and 47. A makeup air damper 59 located on side member 16 opens to maintain a desired dryer negative pressure if the dryer negative pressure exceeds a preset maximum value. The dryer afterburner 55 includes, among other members, a variable speed exhaust fan 56, powered by exhaust fan motor 58 and having an inlet screen 60. The fan 56 draws solvent-laden or otherwise flammable gaseous enclosure air through the fan inlet 57 and propels the air through a metal duct 62 to a ceramic insulated combustion compartment 64. The air combusts in or near the flame of a burner 66 where the remaining solvent can be rapidly oxidized down stream of the flame of the burner 66. A gas supply duct 68 supplies gas to the burner 66. The burner 66 is a raw gas type burner with partial premix of combustion air. The partial premix stabilizes the flame when the exhaust air stream becomes low in oxygen, below 16% oxygen, by way of example and for purposes of illustration only. The gas supply delivered through the gas supply duct can also include a full air and methane premix. Methane, air, and residual heavy weight hydrocarbons $C_{12}$–$C_{23}$ from the dryer enclosure are combusted in the burner 66. A perforated air flow straightener plate positions about the lower portion of the burner 66 to distribute the output of the variable speed exhaust fan evenly across the burner 66. A profile plate 72 positions horizontally across the ceramic insulated combustion compartment 64 and about the burner 66 to regulate or modify air flow differential between the area above and the area below the burner. Down stream combustion can be further augmented by an optional high space velocity monolith catalyst 74 as desired. The catalyst 74 secures in a transition chamber 76 between the ceramic insulated combustion compartment 64 and a heat distribution chamber 78. The catalyst can be a bead or monolithic form or bead-monolithic form, each of which can include a precious metal, a base metal, a precious metal and a base metal combination, or any other form of catalyst as required either in a bead form, monolithic form, or a combination of bead form and monolithic form. A plurality of expansion joints 80*a*–80*n* as illustrated position between various members of the afterburner, such as between the output of the variable speed exhaust fan 56 and the ceramic insulated combustion compartment 64, between the combustion compartment 64 and the transition chamber 76, between the transition chamber 76 and the heat distribution chamber 78, and in the mid-portion of the heat distribution chamber 78.

Heated air from the ceramic insulated combustion compartment 64 is forced by the variable speed exhaust fan 56 into the heat distribution chamber 78, and can be channeled into either of two directions. First, heated air from the heat distribution chamber 78 can pass to the exterior of the dryer enclosure 11, through an exhaust duct 82 protruding perpendicular from side member 16 and through servo controlled hot exhaust damper vanes 84*a*–84*n* contained in the flow path of the exhaust duct 82 and to atmosphere through a flue 85. Second, the other portion of the heated air can pass from the heat distribution chamber 78 into a hot air return duct 86, through servo controlled hot air return damper vanes 88*a*–88*n*, and into the interior of the dryer enclosure 11 through the end orifice 90 of the hot air return duct 86. An optional sparger assembly 92, including a sparger ring 94, a sparger housing 96, and an inlet screen 97, is illustrated between the hot air return duct 86 and the recirculating fan inlet 100 of the recirculating air supply fan 50. An optional static mixer tube 98 is shown disposed between the optional sparger assembly 92 and the recirculating fan inlet 100. Without utilization of the sparger assembly, the heated air from the interior of the dryer enclosure 11 is drawn partially by the variable speed exhaust fan 56 and partially by the recirculating air supply fan 50. The recirculating air supply fan 50 supplies heated pressurized air through the circulating air plenum 48, the vertical duct 49, and upper and lower supply ducts 44 and 46 to the upper and lower air bars 28*a*–28*n* and 30*a*–30*n* accordingly.

Mixing of dedicated air flow is accomplished by the use of the optional sparger assembly 92. Of course, the end orifice 90 would then be located on the side wall 86*a* of the hot air return duct 86 and aligned with the sparger housing 96. Hot air from the hot air return duct 86 then flows through the hot air return duct 86, the servo controlled hot air return damper vanes 88*a*–88*n*, through the end orifice 90, through the sparger housing 96, through a plurality of holes 102*a*–102*n* in the sparger ring 94, into the recirculating air supply fan 50, and through the appropriate supply ducts. This supplies heated pressurized air to the upper and lower air bars 28*a*–28*n* and 30*a*–30*n*. Approximately 75% of the system air flow passes through the recirculating air supply fan 50 to the upper and lower air bars 28*a*–28*n* and 30*a*–30*n*. As previously described in detail, a portion of the heated air flow can be exhausted overboard through the exhaust duct 82 or through the hot air return duct 86 to maintain internal temperatures in a desired range.

Figure 2:
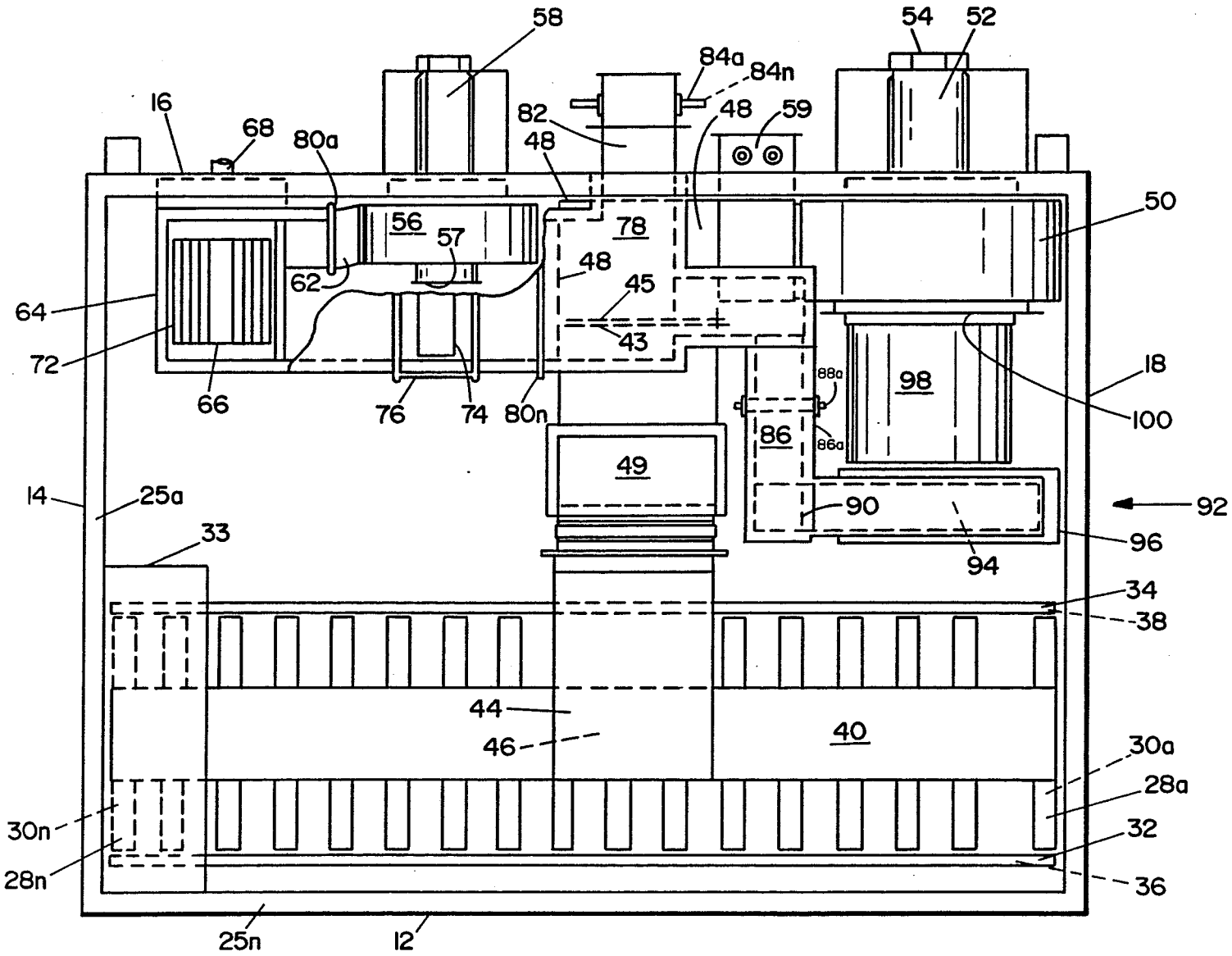
FIG. 2 illustrates a top view in cutaway cross section of an air flotation dryer with a built-in afterburner.

FIG 2 illustrates a top view in cutaway cross section of the dryer 10 where all numerals correspond to those elements previously described. Shown in particular detail is the vertical duct 49 connected between the circulating air plenum 48 and the upper supply duct 44.

Figure 3:
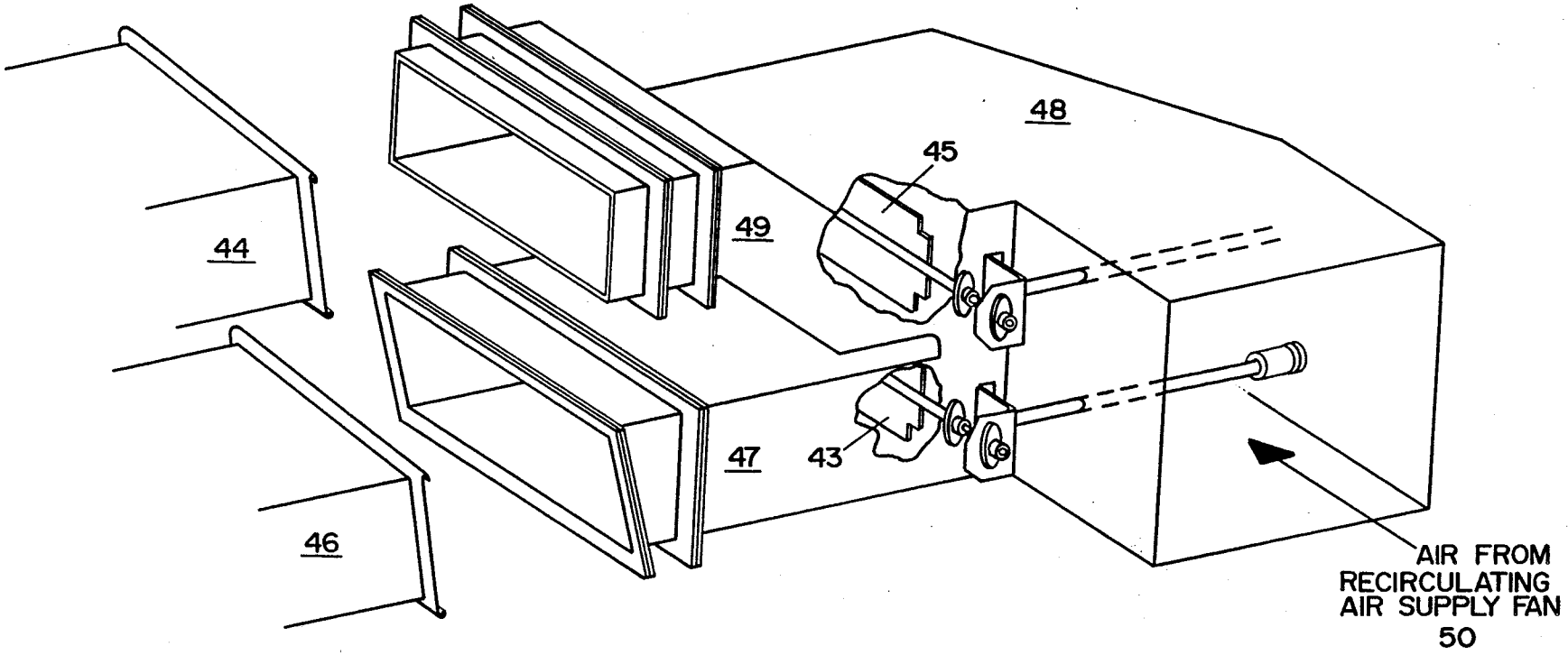
FIG. 3 illustrates a perspective view of the circulating air plenum.

FIG. 3 is a perspective view of the circulating air plenum 48 illustrating a vertical and horizontal ducts 49 and 47, and motor driven dampers 45 and 43 interposed between the circulating air plenum 48 and the ducts 49 and 47. The upper and lower supply ducts are also illustrated for connection to ducts 49 and 47. Placement of the circulating air plenum 48 can be referenced on FIG. 2 wherein the plenum is located partially beneath the heat distribution chamber 78 and to the left of the recirculating air supply fan 50 and hot air return duct 86.

Figure 4:
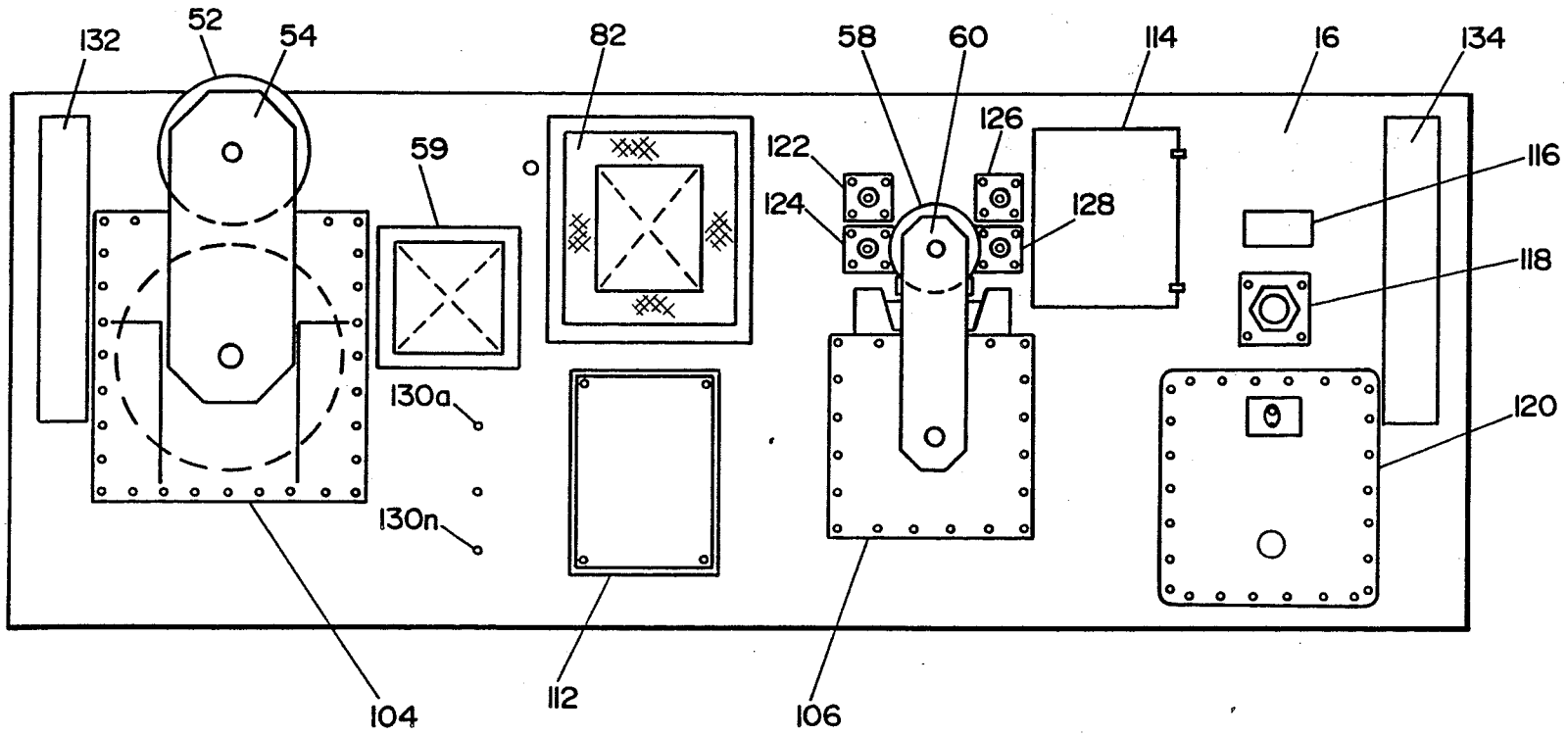
FIG. 4 illustrates a rear view of an air flotation dryer with a built-in afterburner.

FIG. 4 illustrates a rear view of the dryer 10 where all numerals correspond to those elements previously described. Motors 52 and 58 and the respective drive mechanisms secure to mounting plates 104 and 106 on the side member 16. Other elements mounted on the side member 16 include the makeup air damper door 59, the exhaust duct 82, an access door 112, a catalyst access door 114, an ultraviolet scanner 116, a burner sight port 118, a burner access door 120, high temperature limit switches 122 and 124, thermocouples 126 and 128, and a plurality of inside air sample ports 130*a*–130*n*. Enclosures 132 and 134 enclose assemblies for raising or lowering the upper and lower air supply headers 40 and 42.

Figure 5:
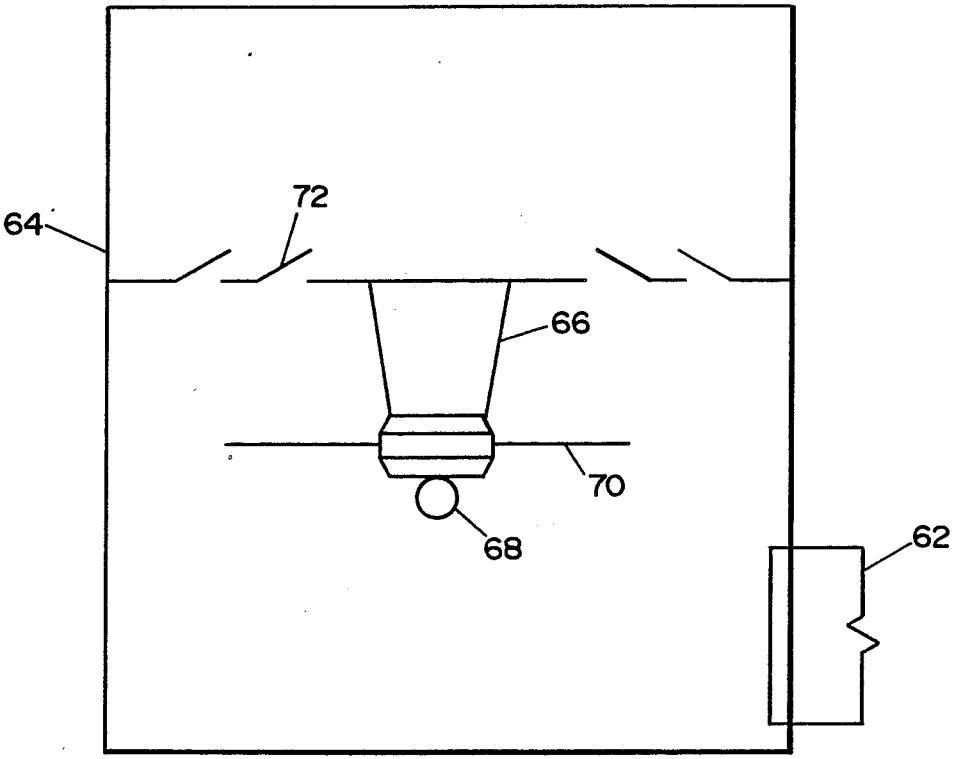
FIG. 5 illustrates a side view of the combustion compartment.

FIG. 5 illustrates a side view of the ceramic insulated combustion compartment 64 where all numerals correspond to those elements previously described. Plate 70 is a perforated air straightener plate for channeling incoming air from the metal duct 62 vertically through or adjacent to the burner 66. The profile plates 72 are adjustable to control air passage rates through and by the burner 66, and to also control combustion rates in the ceramic insulated combustion compartment 64.

MODE OF OPERATION

FIGS. 1–5 illustrate the electromechanical mode of operation of the dryer 10. A typical graphic arts dryer may have a "web" heat load of 500,000 net Btu/hr. This is the heat required to "dry" the ink on the paper web. Typically, the supply air temperature is about 350° F.+/−150° F., and the final web temperature is about 300° F.+/−100° F. In the present invention, spent, solvent-laden air is exhausted through a variable speed exhaust fan 56, through a metal duct 62, and past a burner 66 where the exhaust stream is heated to about 1600° F. Most of the solvent in the exhaust stream is combusted in or near the burner flame, and the remaining solvent is oxidized rapidly downstream of the burner flame. Downstream combustion may be augmented by an optional high space velocity monolith catalyst 74 if desired.

The burner 66 is a raw gas type burner with partial premix of combustion air. The partial premix stabilizes the flame when the exhaust air stream becomes low in oxygen such as below 16% oxygen.

One factor of operation is high temperature combustion of 600° to 2200° F. with the hot combustion compartment 64 being completely contained within the dryer enclosure 11. Due to high temperature of the exhaust through the heat distribution chamber 78, the exhaust rate is lowered by the hot exhaust damper vanes 84*a*–84*n*. The solvent concentration is controlled to 50% or less of lower flammability limit (LFL) indirectly by the variable speed exhaust fan 56 which control combustion compartment pressure. An air gap is left between the exterior of the combustion compartment 64 and the internal cladding sheets 23*a*–23*n* of the dryer walls, top, side, and bottom members 12–22 which minimizes the need for insulation in the combustion chamber.

The speed of the variable speed exhaust fan 56 is controlled to maintain a constant combustion chamber pressure. After startup, the overall exhaust rate is reduced by closing the ceramic alloy hot exhaust damper vanes 84*a*–84*n* until an LFL of 50% is reached or until a preset minimum is reached or until a specific box negative pressure is reached. Solvent concentration is monitored with the lower flammable limit (LFL) monitor. The LFL monitor overrides the normal control of hot exhaust damper vanes 84*a*–84*n* to maintain the LFL of 50-% or less. The firing rate of the burner 66 is controlled by the temperature set point in the ceramic insulated combustion compartment 64. The supply air "web drying air" temperature is controlled by servo controlled hot air return damper vanes 88a–88n which allows hot combustion products to flow directly back to the recirculating fan inlet 100. An optional sparger assembly 92 and/or static mixer tube 98 can be used to enhance the mixing of the hot return air from the hot air return duct 86 with the supply air.

Figure 6:
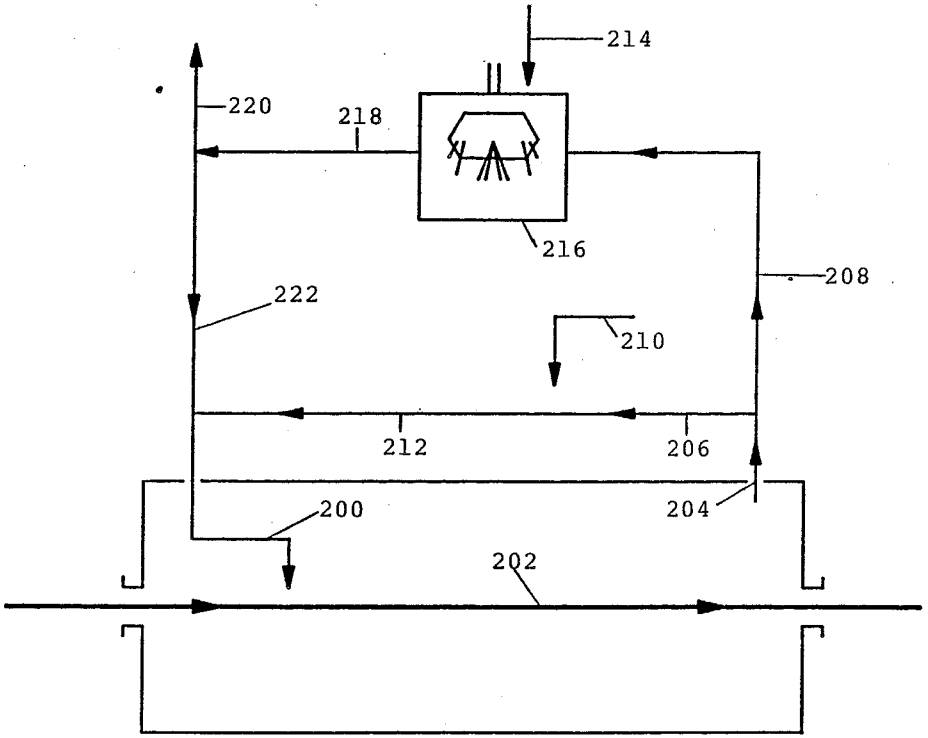
FIG. 6 illustrates an air flow schematic diagram for the air flotation dryer with a built-in afterburner.

FIG. 6 illustrates an air flow schematic diagram of the air flotation dryer with a built-in afterburner. The flow paths of the solvent laden air corresponds to the structure of FIGS. 1–5.

The computer control of the built-in variable speed exhaust fan, dampers, makeup air, burner temperatures, and box pressures is utilized to maintain optimum combustion chamber temperature, supply air temperature, supply air flow, solvent concentration (LFL), and exhaust air rate. High clean-up efficiencies of 99% and higher can be achieved with the synergistic system.

Figure 7:
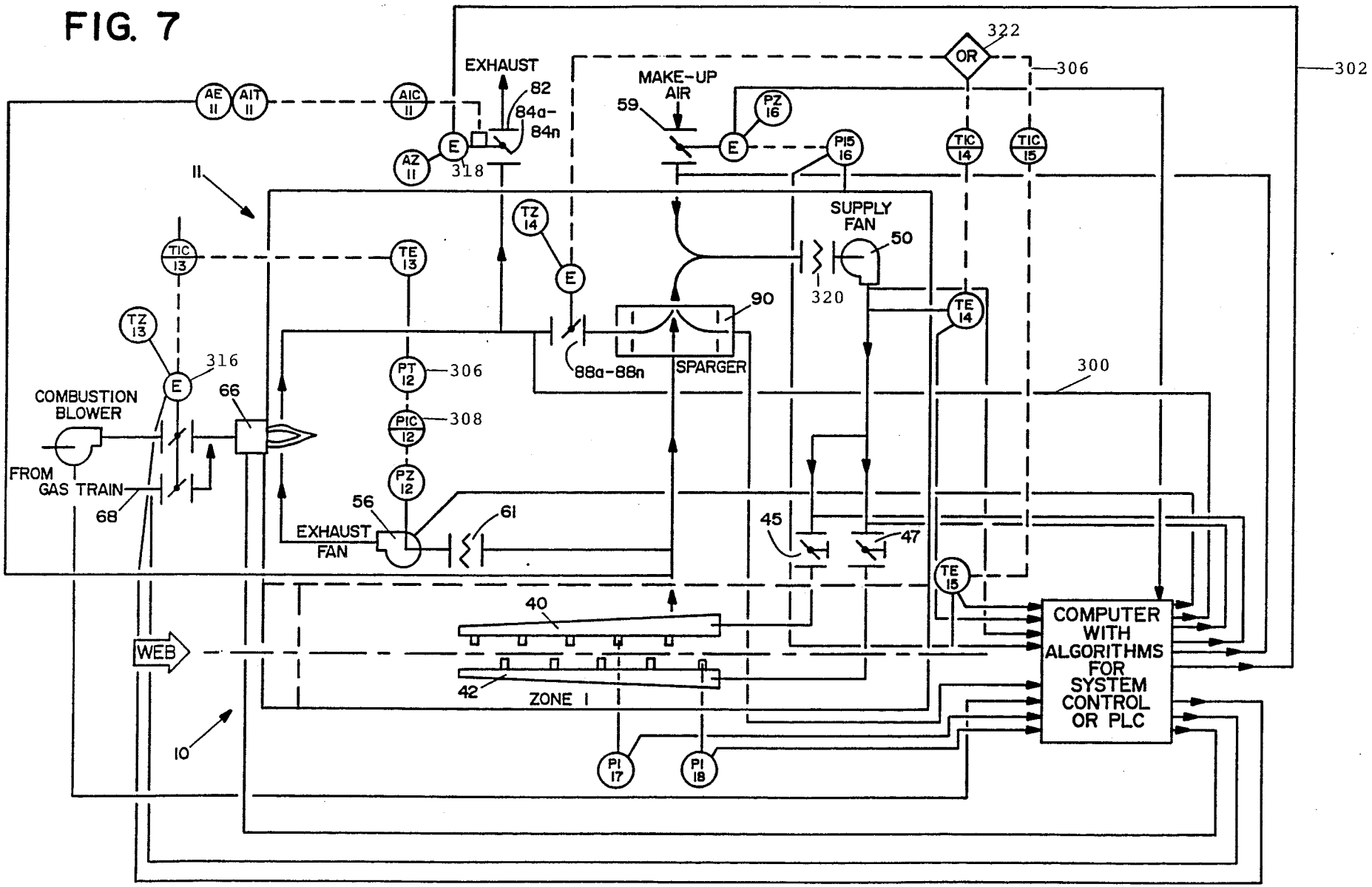
FIG. 7 illustrates a electromechanical computer control diagram of the air flotation dryer with a built-in afterburner with a computer connected to the components.
Figure 8:
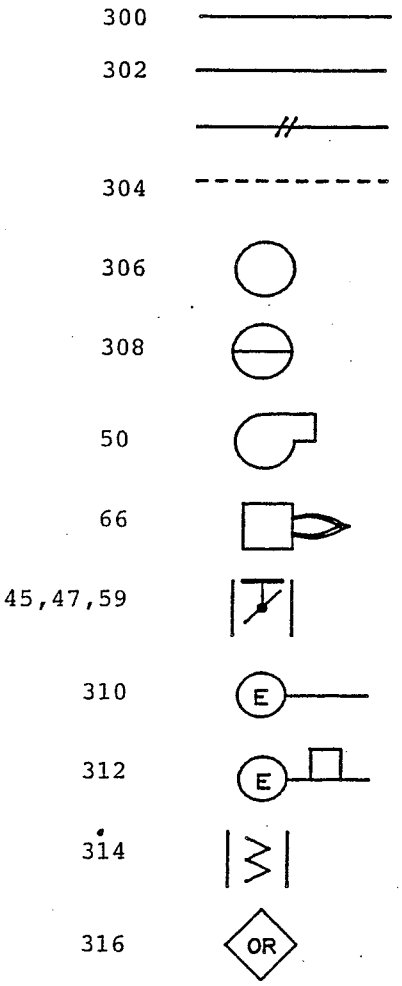
FIG. 8 illustrates the legends for FIG. 6.

FIG. 7 illustrates an electromechanical computer control diagram for the dryer 10. All numerals correspond to those elements previously described. FIG. 6 can be controlled such as by a microprocessor based computer or a programmable logic controller (PLC). FIG. 8 illustrates the legends for FIG. 7. The instrument identification letters are set forth below in Table 1. While not specifically illustrated by lines in the figure, all instrumentation is wired to the computer to input operational parameters.

TABLE 1

Instrument Identification Letters

Figure 9A:
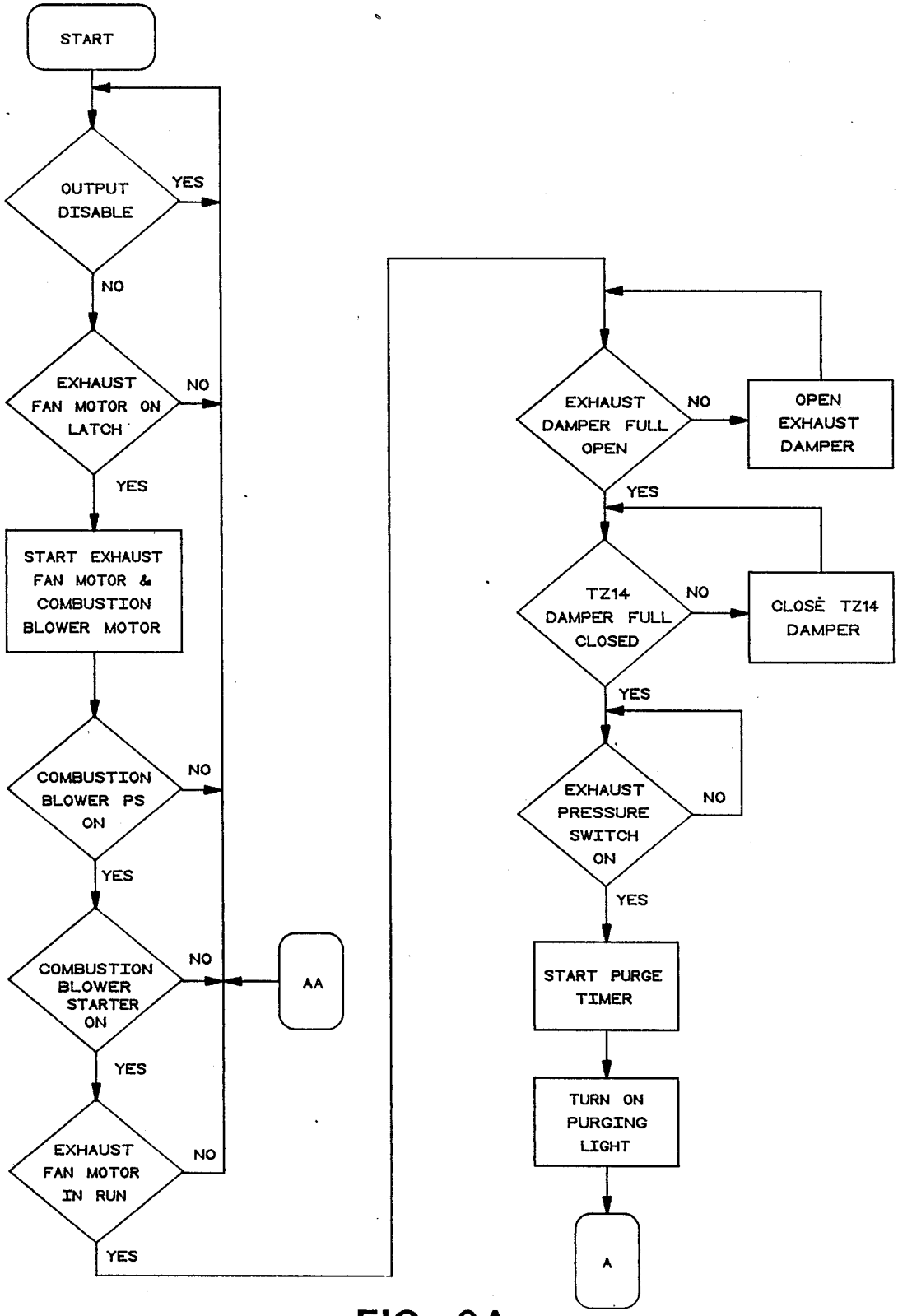
FIG. 9A–9G illustrate a flow chart for the computer of FIG. 7.
Figure 9B:
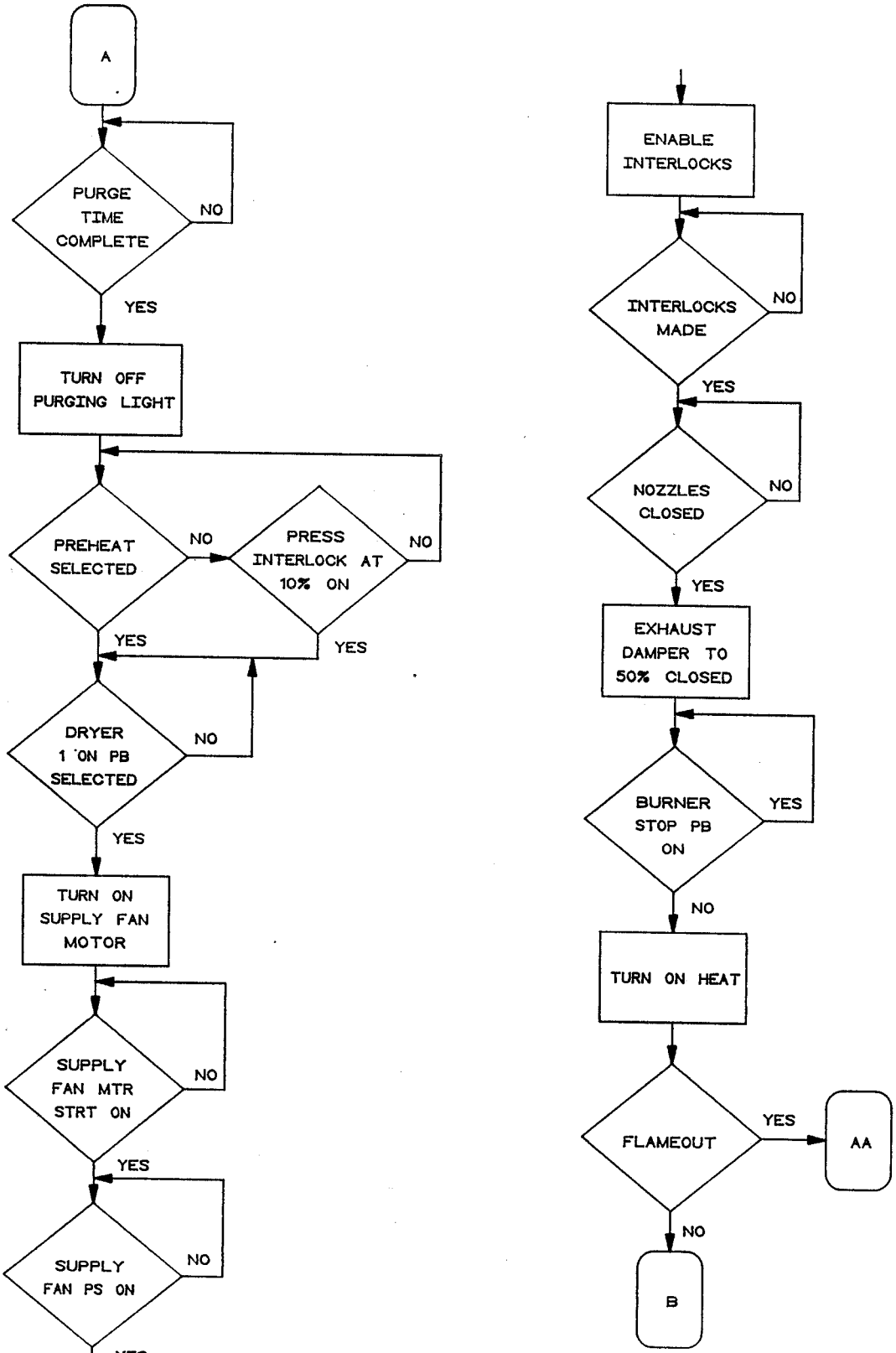
Figure 9C:
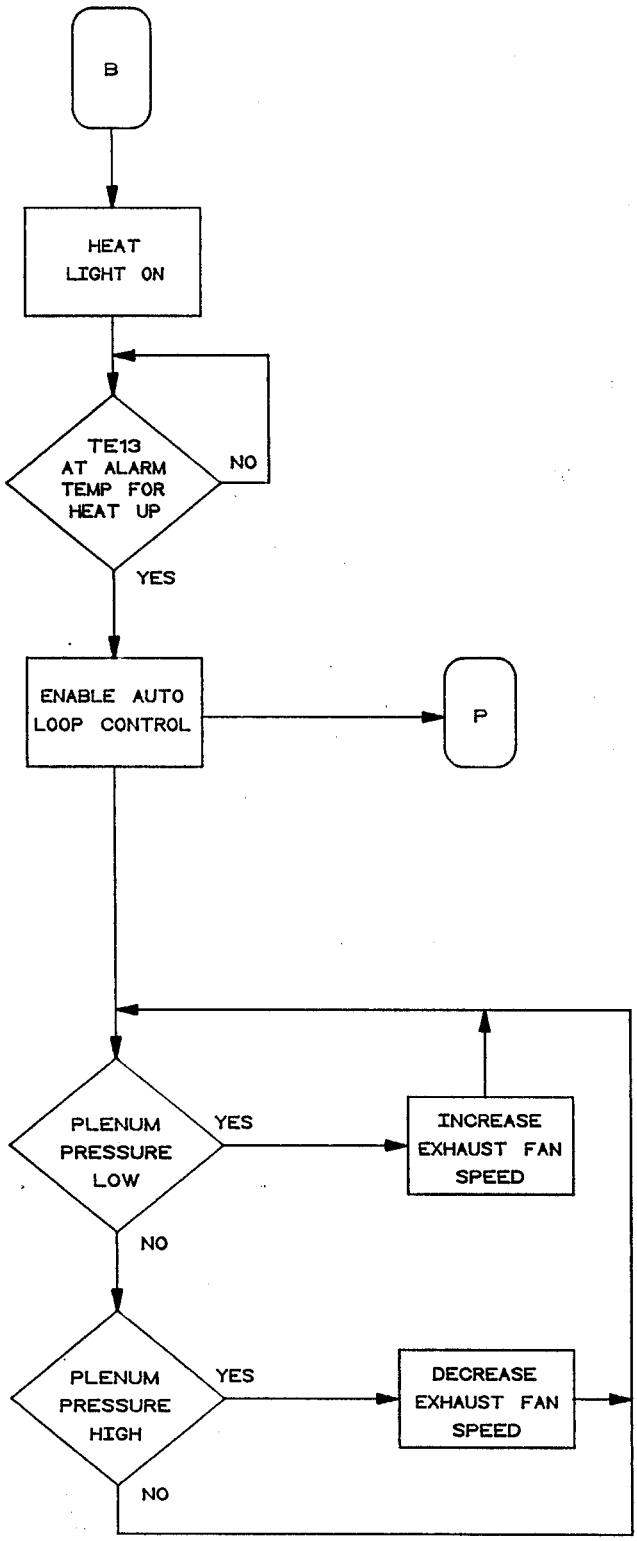
Figure 9D:
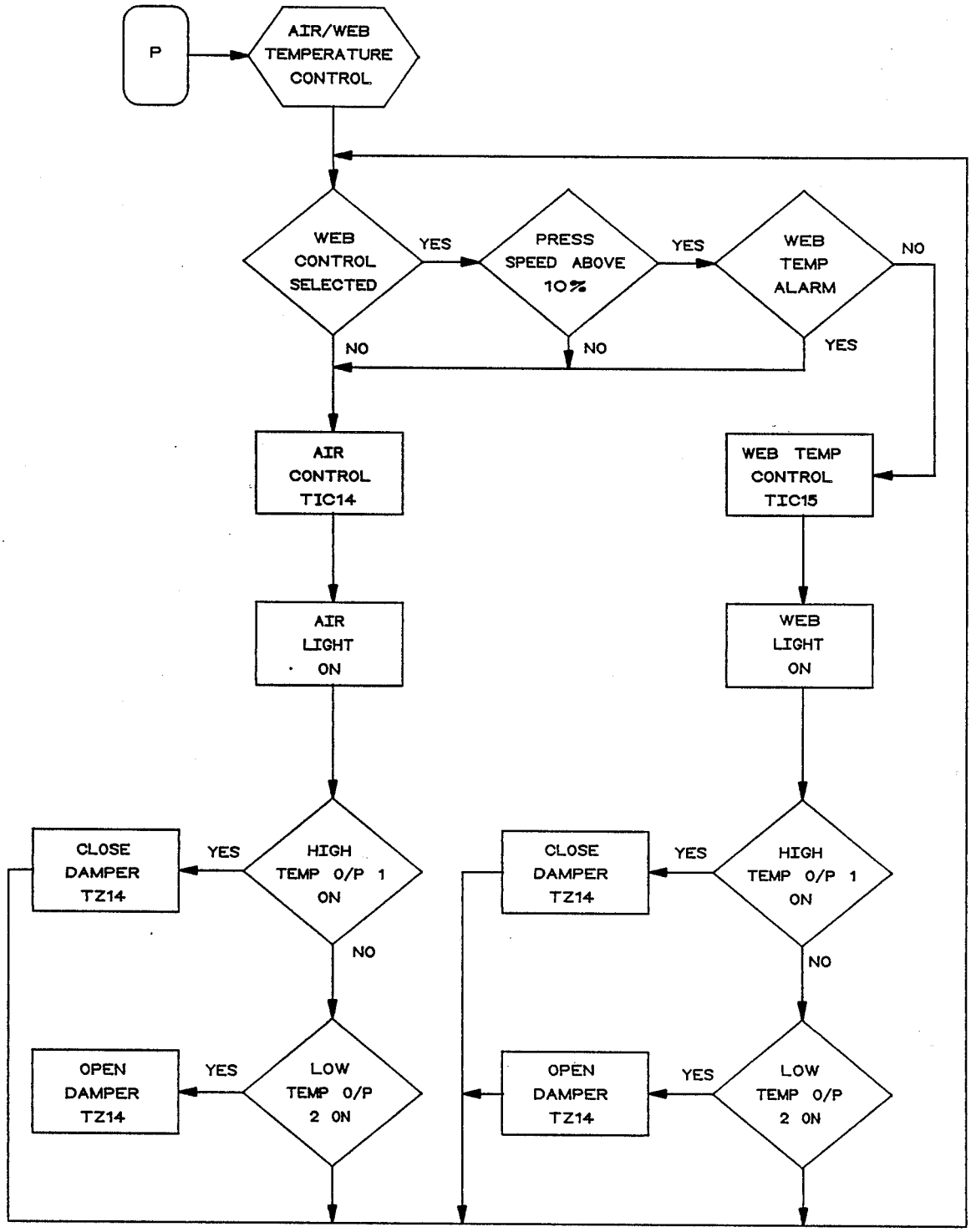
Figure 9E:
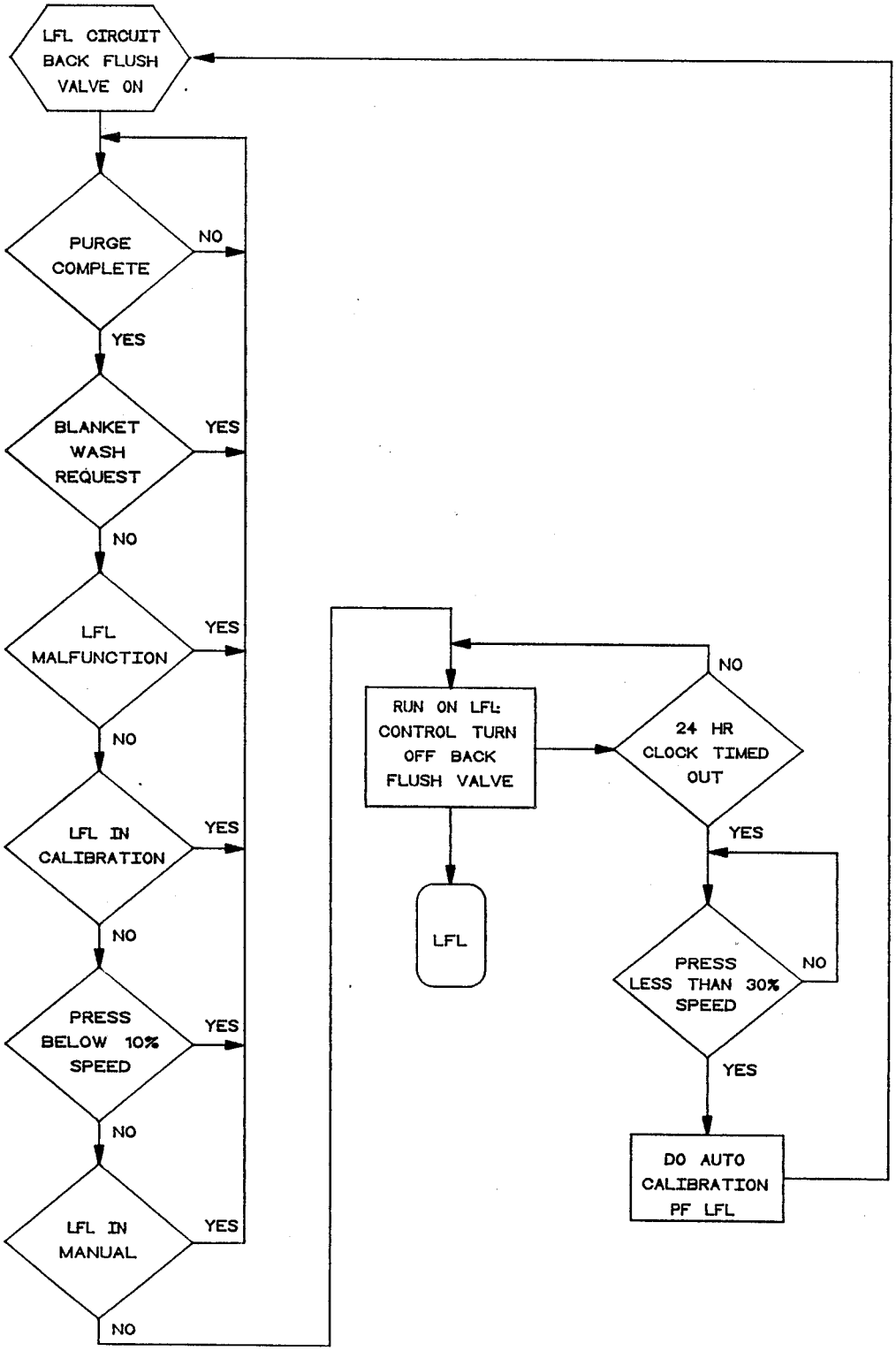
Figure 9F:
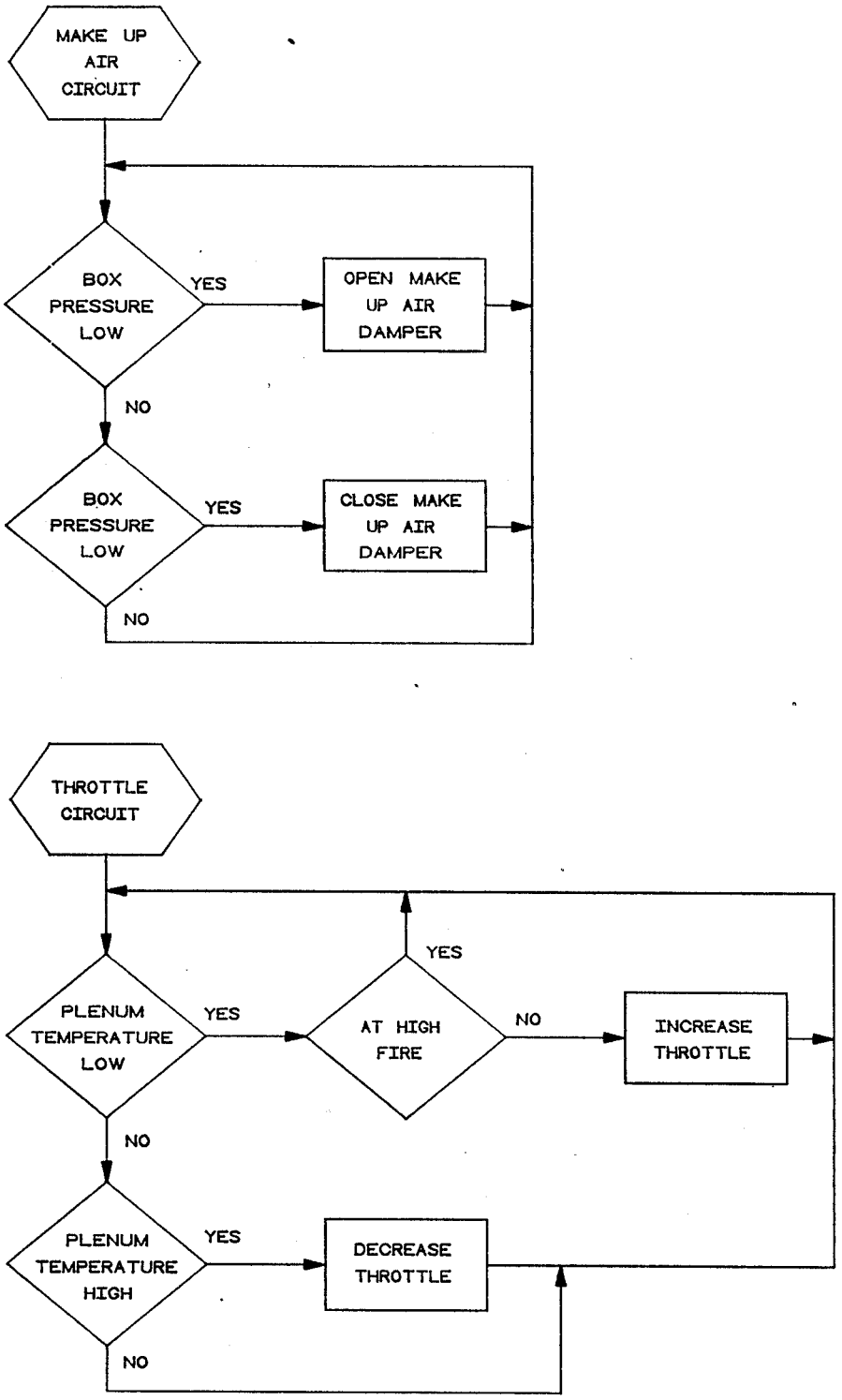
Figure 9G:
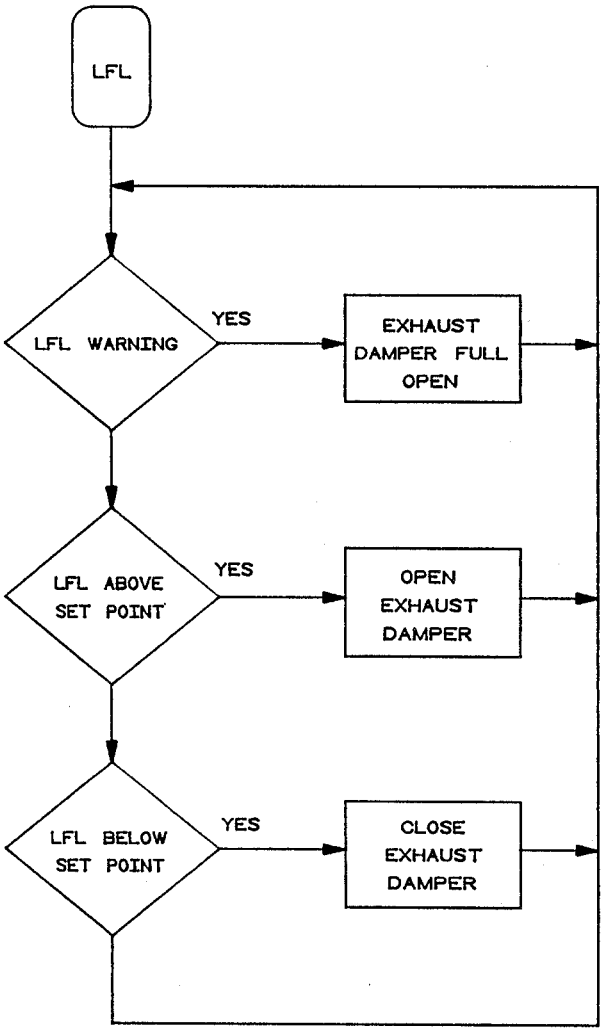

AE—Analysis Element
AIC—Analysis Indicating Controller
AIT—Analysis Indicating Transmitter
AZ—Analysis Final Control
PI—Pressure Indicator
PIC—Pressure Indicating Controller
PIS—Pressure Indicating Switch
PT—Pressure Transmitter
PZ—Pressure Final Control
TE—Temperature Element
TIC—Temperature Indicating Controller
TZ—Temperature Final Control FIGS. 9A–9G illustrate flow charts for one subroutine for controlling the computer of FIG. 7. FIGS. 9A–9D pertain to initializing system operation and real time processing control during the running of the air flotation dryer with the built-in afterburner. FIGS. 9E–9F pertain to the LFL subroutines. FIG. 9G pertains to the make up air and the plenum temperature.

During startup, the exhaust damper is open to a preset maximum, and after a startup cycle, the exhaust damper starts to close automatically in order to reduce the exhaust rate and increase the LFL. The exhaust damper continues to close until either the LFL reaches 50%, the damper setting reaches a preset minimum, or until the dryer box negative pressure reaches a present minimum value.

During purge, startup, blanket wash and idle cycles, the exhaust fan speed and damper positions are held at preset values.

Based on the rapid warm-up time, there does not need to be any fuel consumption during idle time.

If box negative pressure exceeds a preset maximum value, the makeup air damper opens to maintain a desired box negative pressure.

The computer and the program controls the exhaust fan speed, the damper positions, and the burner firing rate.

The computer monitors solvent concentration with an LFL monitor. The computer also controls exhaust fan speed with respect to plenum pressure, controls burner firing rate based on the combustion chamber temperature, and controls supply air temperature via position of the hot return damper which allows hot combustion products to return to dryer recirculation fan (supply air fan) inlet. The computer also controls LFL exhaust rate by the exhaust fan speed and controls plenum pressure via position of the exhaust damper.

The control system provides the following operating criteria. The dryer supply air and combustion chamber temperatures reach operating set point within a period after a cold startup. The combustion chamber temperatures are between 1200° to 1900° F. The dryer supply air temperature holds within +/−10° F. of set point and combustion chamber temperature hold within +/−50° F. of set point. The exhaust air flow rate is high enough to control dryer solvent concentration below 50% of LFL and prevent belching, and otherwise is at a minimum to reduce fuel consumption. The combustion chamber plenum pressure remains fairly constant to prevent erratic burner behavior. The oxygen level remains high enough to allow operation of an LFL monitor. The system is able to operate with only one burner, but may operate with additional secondary burners if desired. The VOC reduction must be 99% conversion or better. The system is able to operate without any heat exchanger, but may utilize a heat exchanger if desired. There is minimized fuel consumption during idle time.

The control system provides for efficient hydrocarbon cleanup. The system maintains a predetermined web temperature while controlling and monitoring operating parameters. The speed of the exhaust fan is adjusted up or down to maintain a predetermined pressure in the combustion compartment or the heat distribution compartment. The hot air return damper is controlled by the temperature of the web or the supply air as predetermined and chosen. The burner firing rate is controlled to maintain a predetermined temperature in the combustion chamber. The makeup damper opens if the box negative pressure reaches a preset maximum. The system also monitors door interlocks and the burner flame. The exhaust damper is closed until the LFL is 50% or a predetermined maximum. If the exhaust damper reaches a predetermine minimum before the LFL is 50%, then the exhaust damper stops closing; or, if the box negative pressure reaches a predetermined minimum, then the exhaust damper stops closing. The system, in response to an LFL of greater than 50%, opens the exhaust damper and if the LFL rises above 60%, the system is shut down. The algorithm stored in the computer provides real time processing to control parameters in response to sensed parameters.

Various modifications can be made to the present invention with departing from the apparent scope hereof. Components can be located external to the housing and ducted accordingly for connection thereto. One example would be the exhaust fan. The damper vanes or vanes can be one or more as so determined.

Ceramic may or may not be used for insulation of ducts and vanes.

We claim:

1. Control system for an air flotation dryer for vaporizing hydrocarbons from a web of material having an afterburner including an enclosure containing internally supported opposing air bars supplied by a plenum, said control system comprising:

a. means about air bars for monitoring pressure in said plenum and a hot air return damper connected to said plenum;

b. means in said afterburner for monitoring temperature in a combustion chamber, and a variable speed exhaust fan connected to supply air to said combustion chamber;

c. computer means connected to said combustion chamber temperature monitoring means and said plenum pressure monitoring means; and d. algorithm in said computer means for controlling exhaust fan speed for said enclosure, for controlling position of an exhaust damper on said enclosure, for controlling plenum pressure, controlling burner firing rate of said afterburner, and for controlling position of said hot air return damper.

2. Control system of claim 1 wherein said computer means is a programmable logic controller.

3. Control system of claim 1 including means for controlling pressure within said enclosure in response to a pressure sensor.

4. Control system of claim 1 including means for controlling a hot air return damper in response to a combination of the temperature of said web and said supply air.

5. Control system of claim 1 including means for maintaining temperature of said web.

6. Control system of claim 1 including means for maintaining the concentration of said hydrocarbons with said enclosure in a predetermined range.

7. Control system of claim 1 including safety interlocks and means for monitoring said safety interlocks.

8. Control system of claim 1 including means for monitoring the burner flame.

9. Control system of claim 1 including means for controlling burner firing rate to maintain a predetermined temperature in said combustion chamber.

10. Control system of claim 1 including means for opening and controlling said makeup damper if said enclosure has a negative pressure.

11. Control system of claim 1 including means for controlling speed of said exhaust fan to maintain a predetermined pressure in said combustion compartment.

12. Control system of claim 1 including a heat distribution compartment and means for controlling speed of said exhaust fan to maintain a predetermined pressure in said heat distribution compartment.

13. Control system of claim 1 including means for controlling exhaust damper position in response to LFL concentration.

14. Control system of claim 1 including means opening said exhaust damper in response to a high LFL concentration.

15. Control system of claim 1 including means for shutting down in response to sensing a high LFL.

16. Control system of claim 1 including means for controlling exhaust damper position in response to sensing a predetermined pressure in said enclosure.

17. Control system of claim 1 wherein said supply air includes oxygen and said hydrocarbons include methane and further comprising means for controlling oxygen concentration in response to sensing methane concentration.

18. Control system of claim 1 wherein said computer means is a microprocessor.

19. Control system of claim 1 wherein said computer means is relay logic.

20. Control system of claim 1 wherein said computer means is a microprocessor.

21. Control system for an air flotation dryer with built-in afterburner for evaporating solvent including an enclosure having internally supporting opposing air bars, said control system comprising:

a. means in said air bars for monitoring plenum pressure of said air bars;

b. means in an afterburner for monitoring combustion chamber temperature;

c. computer means connected to said monitoring means for concentration of said solvent, said combustion chamber temperature monitoring means and said plenum pressure monitoring means;

d. a variable speed exhaust fan within said enclosure; and, e. algorithm in said computer means for controlling exhaust fan speed for said enclosure and for controlling position of an exhaust damper.

22. Control system for an air flotation dryer for vaporizing hydrocarbons from a web of material having an afterburner including an enclosure containing internally supported opposing air bars supplied by a plenum, said control system comprising:

a. means about air bars for monitoring pressure in said plenum and a hot air return damper connected to said plenum;

b. means in said afterburner for monitoring temperature in a combustion chamber, and a variable volume exhaust fan connected to supply air to said combustion chamber;

c. computer means connected to said combustion chamber temperature monitoring means and said plenum pressure monitoring means; and d. control logic means in said computer means for controlling exhaust fan speed for said enclosure, for controlling positions of an exhaust damper on said enclosure, for controlling plenum pressure, controlling burner firing rate of said afterburner, and for controlling positions of said hot air return damper.

23. Control system for an air flotation dryer with built-in afterburner for evaporating solvent including an enclosure having internally supporting opposing air bars, said control system comprising:

a. means in said air bars for monitoring plenum pressure of said air bars;

b. means in an afterburner for monitoring combustion chamber temperature;

c. computer means connected to said monitoring means for concentration of said solvent, said combustion chamber temperature monitoring means and said plenum pressure monitoring means;

d. a variable volume exhaust fan within said enclosure; and, e. control logic means in said computer means for controlling exhaust fan speed for said enclosure and for controlling position of an exhaust damper.

* * * * *